US005839331A

United States Patent [19]

Rocheleau

[11] Patent Number: 5,839,331

[45] Date of Patent: Nov. 24, 1998

[54] FLANGE TIGHTENING TOOL

[76] Inventor: John W. Rocheleau, 82 Warren St., Concord, N.H. 03301

[21] Appl. No.: 897,741

[22] Filed: Jul. 21, 1997

Related U.S. Application Data

[63] Continuation-in-part of Ser. No. 679,144, Jul. 12, 1996.

[51] Int. Cl.[6] ..... B25B 13/48

[52] U.S. Cl. ..... 81/176.15; 81/176.2

[58] Field of Search ..... 81/176.15, 176.2, 81/461

[56] References Cited

U.S. PATENT DOCUMENTS 1,681,126 8/1928 McDonnell ..... 81/176.15
4,181,048 1/1980 Norton ..... 81/176.15

*Primary Examiner*—James G. Smith
*Assistant Examiner*—Lee Wilson
*Attorney, Agent, or Firm*—William B. Ritchie

[57] ABSTRACT

A flange tightening tool for use in securing a flange to a pipe. The tool has a base plate, a tightening hexagonal shoulder, two attachment openings, two quick release disconnect mechanisms and a rotating handle perpendicular to the tightening base plate. The hexagonal shoulder enables the tool to be used with a companion light weight wrench. The tool can also be used with an open end wrench or an adjustable wrench. A rotatable handle is attached to the hexagonal shoulder such that said handle is perpendicular to the face of a flange that is to be tightened and can be used to hold the tool against the flange. When the quick release disconnect mechanisms are depressed about the pivot pin the quick release disconnect mechanism detracts from the mounting members releasing the mounting member separating the base plate and the flange. The tool prevents over tightening since the flange cannot be tightened past the point where the pipe contacts the base plate. An adapter plate enables the tool to be used with an additional size of flange.

7 Claims, 5 Drawing Sheets

48
45

72
42
71

49
48
45
44
74
72
40
41

FLANGE TIGHTENING TOOL

This Application is a Continuation-in-Part of U.S. application Ser. No. 08/679,144 filed on Jul. 12, 1996.

BACKGROUND OF THE INVENTION

1. Field of the Invention

This invention relates to flange tightening tools, and more specifically to an improved flange tightening tool for the easy installation of a pipe flange.

2. Description of Related Art

A flange is typically used to connect a pump or flow controlling device to a pipe, or a pipe to another pipe directly. Connections of this type are used extensively in the plumbing and heating industry, especially with steel or copper pipe. Flanges are secured to pipe ends by means of interior flange threads rotated to attach to the exterior pipe threads. One problem encountered when attaching pipe flanges to pipe ends is that the elliptical shape of the flange does not readily accommodate a standard pipe wrench or other tightening device. It is therefore difficult to attach a pipe flange to the pipe end. Additionally, a pipe flange must often be attached to a pipe when the pipe is extremely close to a wall, other pipes, or even worse, a corner. Therefore, there is little room to use a standard pipe wrench. Since the force required to attach the flange to the pipe is substantial, tightening is usually possible only when force is applied to the pipe wrench moving with gravity, i.e., within the 180 degree arc corresponding to the hour hand of a clock moving from the 12 o'clock position to the 6 o'clock position. A typical flange has a shoulder that a pipe wrench can be placed on to tighten the flange. However, when the elliptical ends of the flange have turned within the 180 degrees tightening arc, the wrench must be readjusted. This is a time consuming process. The weight of a typical pipe wrench is considerable, thus additionally fatiguing the user. Moreover, as the size of a pipe wrench increases the length of the handle increases proportionally. While the jaws of a pipe wrench are adjustable within a predetermined range for a given size, the length of the handle is fixed thus limiting its use in space constrained areas.

Another problem with attaching a pipe flange to a pipe end is that the flange is not intended to be rotated past the flange end. Thus, users may over tighten the flange causing the pipe to protrude, or they may fail to adequately tighten the flange, resulting in leaks. It is important for individuals who work with flanges to have an effective tool for tightening and removing flanges.

Another problem with typical flange attachment tools is that the typical flange tool is bolted onto the pipe flange to tightly secure the tool to the pipe flange. Therefore, once the pipe flange is tightened onto a pipe end the flange attachment tool must be unbolted from the pipe flange. Depending upon the position of the pipe end, the nuts and the bolts used to secure the tool to the pipe flange might be difficult to remove. It is therefore desired to have a flange attachment tool that will allow a user to tightly secure the tool to a pipe flange but also allows the tool to be easily removed.

Devices designed for the attachment of pipe flanges have been addressed in the prior art. U.S. Pat. No. 4,237,755 discloses a pipe flange tool that accommodates two sizes of flanges. This device is attached to the flange and a wrench is attached to the opposite end of the device. The wrench is then used to rotate the device and, in turn, rotate the flange. As noted above, in order to tighten the flange, the wrench must be moved within the 180 degrees arc from 12 to 6 o'clock. The requirement of the universal joint incorporated in this wrench adds some complexity to this tool and requires additional assembly at the job site. It is not designed to work with the basic, standard wrenches commonly carried by plumbers and others that install flanges. Further, this device requires that the wrench be turned at least 90 degrees in each tightening stroke, which is not always convenient depending on the flange location.

U.S. Pat. No. 4,092,882 discloses a water closet flange wrench. This device attaches to water closet flanges and is designed to rotate the flange until the bolt heads are in the desired horizontal position. One aspect of this device permits the user to determine when the bolts are in a horizontal position. This device is designed specifically for a unique type of flange and contains elements that are not desirable for use with typical plumbing wrenches.

U.S. Pat. No. 1,425,845 discloses a simple flange wrench. This device has two arms that attach to the flange and a third arm for use in tightening and loosening the flange. While this device is theoretically adjustable to fit different sizes of flanges, the handle has to be turned 180 degrees before it can be repositioned for the next tightening stroke. As noted above, it is frequently impractical to do this due to the length of the handle. Also, this device does not provide for any means that would prevent the user from over tightening the flange.

Nothing in the prior art provides for or suggests a pipe flange tightening tool that is simple, easy to use in a confined space, can be used with or without a pipe vise, is easily adaptable to fit at least five sizes of flanges, can tighten a flange without concern for over tightening, and has an adjustable handle wrench attachment that is lighter and less costly than typical pipe wrenches with the adjustable handle length being obtained by using user selected lengths of ordinary pipe.

SUMMARY OF THE INVENTION

It is an aspect of the invention to provide a flange tightening apparatus that includes two quick release disconnect mechanisms, for tightening and loosening flanges.

It is another aspect of the invention to provide a flange tightening apparatus that prevents over tightening of the flange.

It is still another aspect of the invention to provide a flange tightening apparatus which is easy to use in an unaccommodating space and can be attached to the flange with ratchet pins for ease of use in "tight" work environments.

It is a final aspect of the invention to provide a flange tightening apparatus that can be used with commonly available wrenches, especially adjustable or open ended wrenches.

The present invention is a flange tightening apparatus that easily attaches to pipe flanges. The apparatus comprises a base plate, a tightening hexagonal shoulder, two attachment openings, and a rotating handle perpendicular to the tightening base plate. The base plate further includes two notches located on the two ends of the base plate by the attachment openings. Each of the two notches contains a quick release disconnect mechanism. The base plate and hexagonal shoulder are preferably one piece that is cast in metal. The hexagonal shoulder enables the tool to be used with an open end wrench including an adjustable wrench. A rotatable handle is attached to the hexagonal shoulder such that the handle is perpendicular to the face of a flange that is to be tightened and can be used to hold the tool against the flange.

The base plate can be attached to the face of the flange with ratchet pins to permit tightening of the flange without having to hold the tool. The tool prevents over tightening since the flange cannot be tightened past the point where the pipe contacts the base plate. A quick release adapter plate enables the tool to be used with a different size of flange, having a different threaded bolt opening size and bolt opening to bolt opening span.

DETAILED DESCRIPTION OF THE INVENTION

Figure 1:
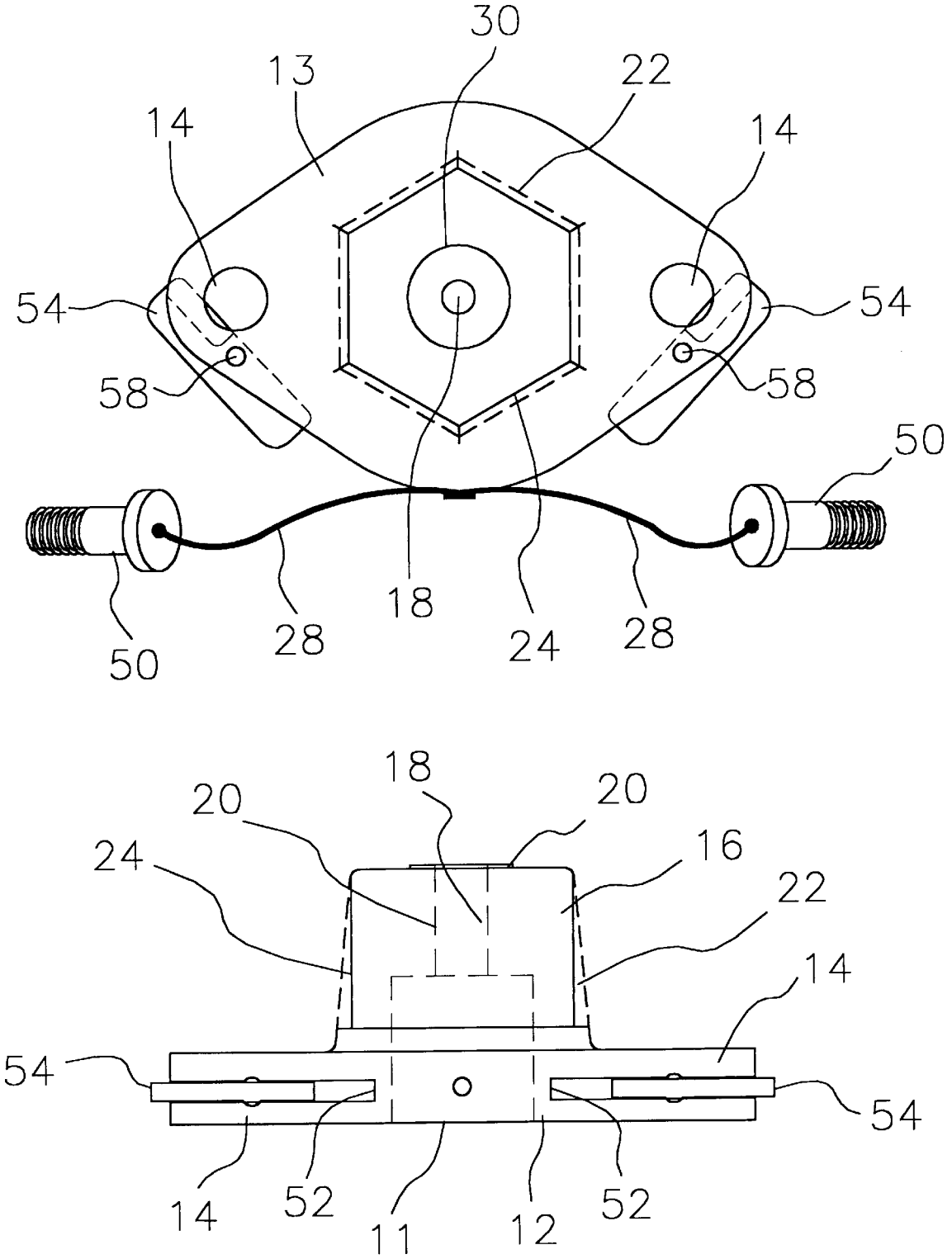
FIG. 1 is a side and top view of the base plate and tightening hexagonal-shaped shoulder in accordance with the present invention.
Figure 2:
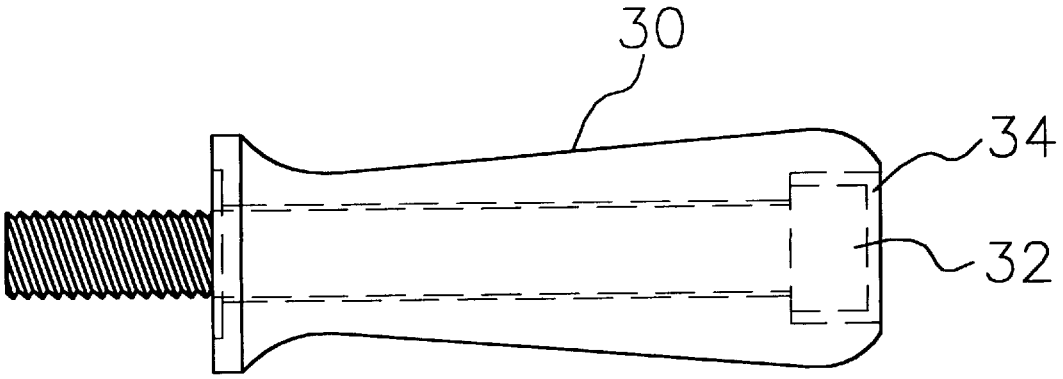
FIG. 2 is a side view of the rotatable handle that is threadably attached to the shoulder.
Figure 3:
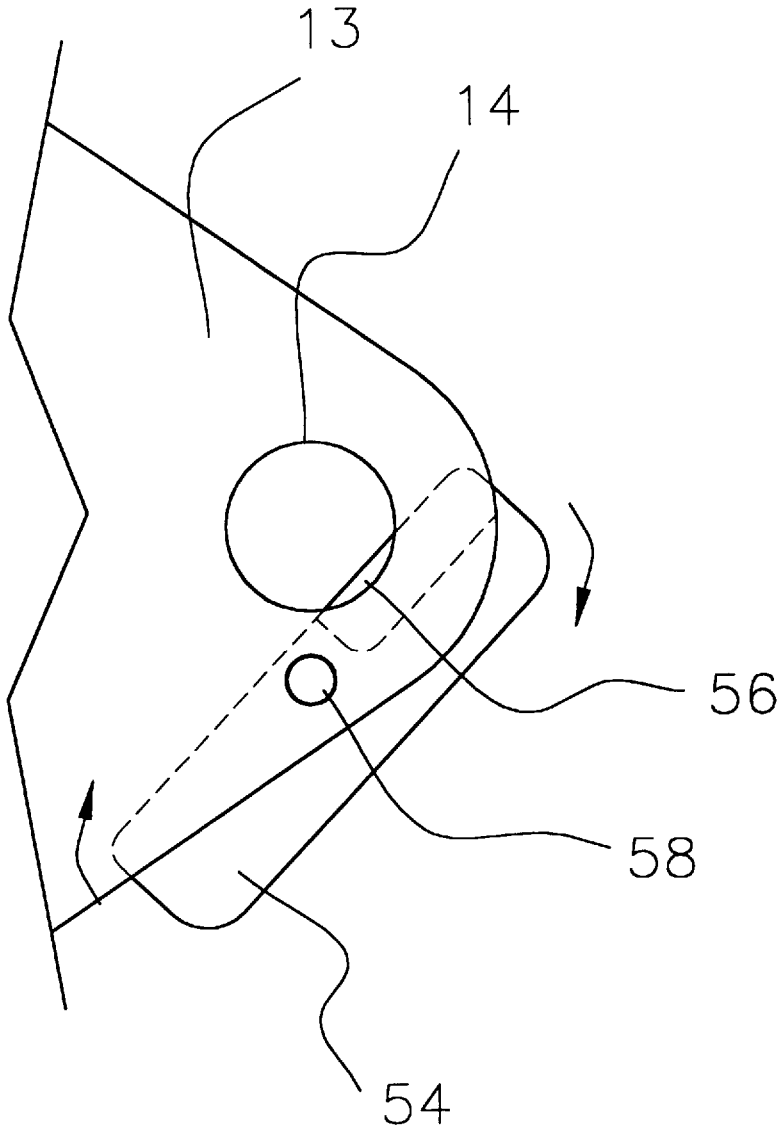
FIG. 3 is a top sectional view of the base plate opening and quick release disconnect mechanisms.

Referring now to FIGS. 1 and 2, base plate 12, hexagonal shaped shoulder 16, and handle 30 are major components of the invention. Preferably, the invention is one piece cast in a ductile iron. This is not critical, and these parts could be made separately. Further, the parts could also be made from another metal alloy or even durable plastic if the plastic would be able to meet the expected stress requirements.

Shoulder 16 has a hexagonal shape 24 that is preferably dimensioned to fit a wrench. The wrench may be an open ended wrench, a closed wrench designed to fit over the shoulder, or even a large adjustable wrench. Since plate 12 and shoulder 16 are preferably sand cast, it is necessary to provide a 2 degree draft or taper so that the tool pattern can be easily removed from the sand mold.

While other sizes could be used, shoulder 16 must be made sufficiently large so that a substantially sized wrench can be used to provide the necessary leverage as noted above without over stressing shoulder 16. Of course, larger flange sizes necessitate greater leverage. Otherwise, the force necessary to tighten the flange may be more than is comfortable or possible for the typical user. Shoulder 16 has mounting opening 18 centered therein. Mounting opening 18 is threaded so that handle 30 can be attached.

Handle 30 is preferably a machined aluminum part. However, other materials would also be acceptable. Handle 30 is attached via bolt 32. Bolt 32 is preferably a ⅜ by 3 inch stripper bolt having a ¼ socket head. However, this is not critical. As shown, bolt 32 is preferably recessed into opening 34 so that the top of handle 30 is free from any protrusions. The length of bolt 32 is sized so that handle 30 is free to rotate when bolt 32 is tightened into opening 18. Preferably opening 18 is machined into shoulder 16, however, an optional insert 20 could be used. Shape 26 is made to conform to the shape of a basic flange but this is not critical.

Now referring to FIGS. 1,2, 3 and 5, base plate 12 has a flat bottom surface 11, a top mounting surface 13, and a pair of attachment openings 14. The openings 14 serve to align the invention 10 to the corresponding size of the flange or to an adapter plate 40, discussed below, using a pair of flange mounting members 50, best seen in FIG. 1. The pair of flange mounting members 50 may be a pair of grooved ratchet pins or other mounting members well known in the art. The pair of flange mounting members 50 may be attached to a pair of wires 28 and the wires may be fastened to the top or side surface of the base. The location where the wires are fastened to the base is immaterial and therefore the wires may be fastened in any suitable location. The pair of flange mounting members 50 each have at least one groove.

Figure 5:
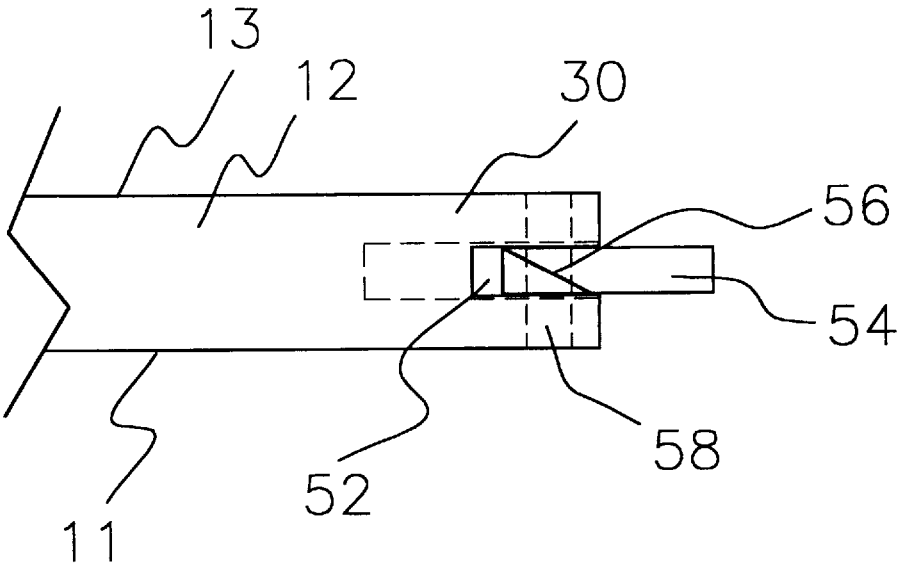
FIG. 5 is a front sectional view of the base plate and the quick release disconnect mechanism.

Fitted under the openings 14, base plate 12 has a pair of notches 52, shown in FIG. 5. Each of the notches 52 contains a quick release disconnect mechanism 54. The mechanism 54 is placed in the notch 52 and secured to the base by a roll pin 58. The mechanism 54 has a tapered edge 56 which when viewed from the top may be seen through the openings 14. The tapered edge 56 of each mechanism engages one of the flange mounting members 50 by one of the grooves in the members 50. Once engaged, each of the flange mounting members is securely locked in place and cannot be loosened from the opening unless the quick disconnect mechanism is depressed such that the tapered edge is detracted from the groove. The mechanism 54 allows a flange or the adapter plate 40, when engaged with the invention, to be easily removed without having to remove a nut from a bolt each time.

When the apparatus is attached to a flange, the flange cannot be over tightened. Once the pipe is flush with the end of the flange, further tightening will cause the pipe to contact flat mounting surface 11 of base plate 12, thus preventing further tightening.

Figures 4A, 4B, 4C:
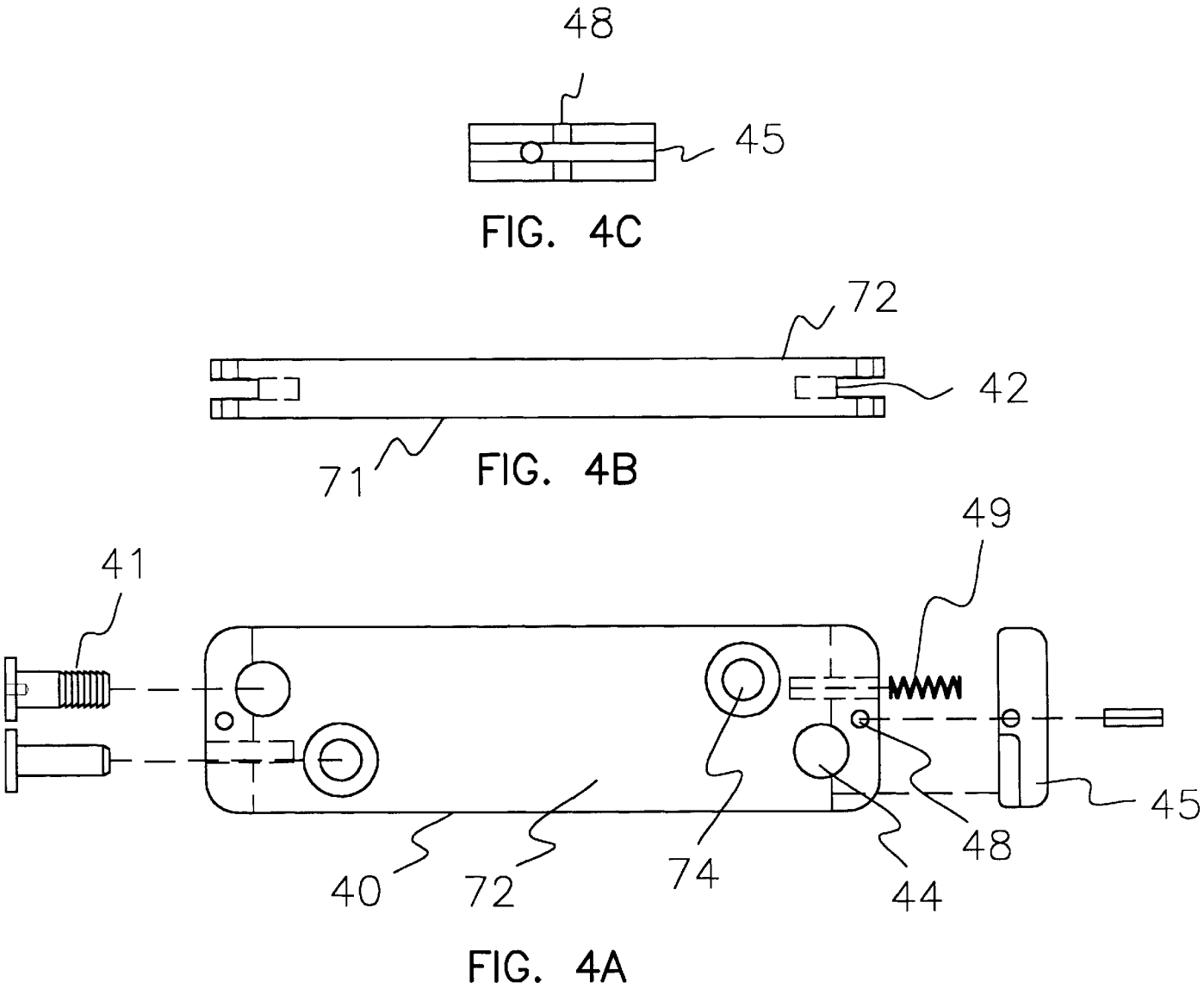
FIG. 4*a* is a top view of the quick release adapter plate that enables the tool to be used with different sizes of flanges.
FIG. 4*b* is a side view of the quick release adapter plate shown in FIG. 4*a*.
FIG. 4*c* is an end view of the quick release adapter plate shown in FIG. 4*a*.

Referring now to FIGS. 4*a*, 4*b* and 4*c*, wherein a top, side and end view of the quick release adapter plate 40 is shown, respectively. As noted above, flanges come in several sizes with each size having its own mounting bolt sizes and bolt to bolt distances and its own shape. In order to enable invention 10 to be used with most common sized flanges, adapter plate 40 provides additional mounting openings. Paired mounting openings 44 match the bolt size and bolt to bolt distance of an additional common size flange. Adapter plate 40 is attached to base plate 12 via flange mounting members 50, which are inserted through openings 74. Fitted under the paired mounting openings 44 is a pair of notches 42. The notches 42 each contain a quick release mechanism 45. The mechanisms 45 are placed in the notches 42 and secured to the quick release adapter plate by a roll pin 48. A spring 49 is used to load the mechanisms 45 or to keep the mechanisms in the locking position. The tapered edge 46 of each mechanism engages a flange mounting member 41, which corresponds to the bolt size of the flange.

Plate 40 is preferably machined from steel stock or aluminum but may be cast from the same alloy as base plate 12. As with base plate 12, a flange cannot be over tightened since once the pipe is flush with the end of the flange, further tightening will cause the pipe to contact region 71 of plate 40, thus preventing further tightening.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A flange tightening apparatus for use in securing a flange to a pipe, the flange having a size, said apparatus comprising:

a base plate having two spaced-apart attachment openings and having a distance between the two spaced-apart attachment openings corresponding to the size of the flange, said base plate also having a flat bottom surface and a top mounting surface, a shoulder attached to the top mounting surface of said base plate and said shoulder having a dimension that corresponds to a wrench, a rotatable handle attached to said shoulder, and substantially perpendicular to the flat bottom surface of said base plate, two quick release disconnect mechanisms being mounted on said base plate;

two flange mounting members, wherein the flange is connected to said base plate by each of the flange mounting members being inserted into one of the two spaced-apart attachment openings thus securely locking the flange to the base plate.

2. The apparatus of claim 1, wherein said base plate further comprises two notches positioned about the two spaced apart attachment openings, each of said two quick release disconnect mechanisms being inserted into one of the two notches, each of said two quick release disconnect mechanisms being fastened to said plate by a roll pin;

each of said two flange mounting members having at least one groove such that when said two flange mounting members are inserted into the two spaced-apart attachment openings, each of said two quick release disconnect mechanisms engages the groove of its respective said flange mounting member.

3. The apparatus of claim 2 wherein the shoulder is hexagonal-shaped.

4. The apparatus of claim 2 wherein each of the flange mounting members being attached to said base plate by one of a pair of wires.

5. The apparatus of claim 4 wherein the pair of wires is fastened to the top mounting surface of said base plate.

6. The apparatus of claim 2 wherein the flat bottom surface engages the flange to prevent further tightening once the flange has been tightened onto said pipe to the point where said pipe engages said flat bottom surface.

7. The apparatus of claim 2 further comprising:

a quick release adapter plate which is attached to said base plate by the two flange mounting members that correspond to the spaced-apart attachment openings in said base plate, said adapter plate having a matched pair of mounting openings corresponding to a particular size of the flange, each of the matched pair of mounting openings having a notch, an additional quick release disconnect mechanism being inserted into each notch and the additional quick release disconnect mechanism fastened to said quick release adapter plate by a roll pin so that attaching a second pair of flange mounting members to said matched pair of mounting openings enables said apparatus to be used to tighten the particular size flange that corresponds to the matched pair of openings.

* * * * *